US008783679B2

(12) United States Patent
Ono

(10) Patent No.: US 8,783,679 B2
(45) Date of Patent: Jul. 22, 2014

(54) SHEET LOADING DEVICE, AND IMAGE FORMING APPARATUS HAVING THE SAME

(71) Applicant: KYOCERA Document Solutions Inc., Osaka (JP)

(72) Inventor: Tomohisa Ono, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/084,397

(22) Filed: Nov. 19, 2013

(65) Prior Publication Data

US 2014/0151957 A1 Jun. 5, 2014

(30) Foreign Application Priority Data

Nov. 30, 2012 (JP) ..... 2012-262642

(51) Int. Cl.
*B65H 31/00* (2006.01)

(52) U.S. Cl.
CPC ..... *B65H 31/00* (2013.01)
USPC ..... 271/207; 271/209

(58) Field of Classification Search
CPC ..... B65H 2511/51; B65H 2511/514; B65H 29/70
USPC ..... 271/207, 209, 152–155, 220
See application file for complete search history.

(56) References Cited

U.S. PATENT DOCUMENTS

| | | | | |
|---|---|---|---|---|
| 6,170,821 | B1 | 1/2001 | Kubota | |
| 6,279,899 | B1 * | 8/2001 | Coffey et al. | 271/220 |
| 2006/0017219 | A1 | 1/2006 | Yamada | |
| 2006/0180999 | A1 | 8/2006 | Suzuki et al. | |

FOREIGN PATENT DOCUMENTS

| | | | |
|---|---|---|---|
| JP | 2003192225 | A | 7/2003 |
| JP | 2004099291 | A | 4/2004 |

OTHER PUBLICATIONS

European Patent Office, Extended European Search Report of EP13194285, Germany, Mar. 25, 2014, 8 pages.

* cited by examiner

*Primary Examiner* — Michael McCullough
(74) *Attorney, Agent, or Firm* — Alleman Hall McCoy Russell & Tuttle LLP

(57) ABSTRACT

A sheet loading device includes a housing, a sheet discharge portion, a sheet loading portion, a plurality of ribs, an actuator, and a sheet detecting portion. A shaft is disposed above the sheet loading portion, and extends in a sheet width direction intersecting a discharge direction. A contact piece extends from the shaft to the sheet loading portion, and rotates integrally with the shaft when a sheet discharged to the sheet loading portion comes into contact with the contact piece. A sheet detecting portion detects, in accordance with the rotation of the contact piece about the shaft, a state where one sheet is loaded on the sheet loading portion, and a state where sheets as many as a predetermined number of sheets regarded as a full load state are loaded on the sheet loading portion.

13 Claims, 11 Drawing Sheets

SHEET LOADING DEVICE, AND IMAGE FORMING APPARATUS HAVING THE SAME

INCORPORATION BY REFERENCE

This application is based upon and claims the benefit of priority from the corresponding Japanese Patent Application No. 2012-262642 filed on Nov. 30, 2012, the entire contents of which are incorporated herein by reference.

BACKGROUND

The present disclosure relates to a sheet loading device for loading sheets, and an image forming apparatus having the sheet loading device.

In an image forming apparatus for forming an image on a sheet, a toner image is formed on a photosensitive drum, and the toner image is transferred to a sheet in a transfer portion. The image forming apparatus includes a fixing portion. The sheet on which the toner image is transferred is subjected to a fixation process in the fixing portion, and thereafter discharged.

The image forming apparatus is provided with a sheet discharge portion serving as a sheet loading device. Sheets subjected to the fixation process are sequentially discharged to and loaded on the sheet discharge portion. It is desirable that a sheet discharge state where only one sheet is discharged and a full load state where the sheet discharge portion is fully loaded with sheets are detected in the sheet discharge portion. As a conventional art, a technique has been known in which when one sheet is placed on an actuator protruding upward from a sheet discharge surface of a sheet discharge portion, the actuator detects a sheet discharge state. Further, a technique has been known in which a filler swingably supported above a sheet discharge portion detects a sheet discharge state and a full load state.

SUMMARY

A sheet loading device according to one aspect of the present disclosure includes a housing, a sheet discharge portion, a sheet loading portion, a plurality of ribs, an actuator, and a sheet detecting portion. The sheet discharge portion discharges a sheet in a predetermined discharge direction. The sheet loading portion is disposed in the housing. The sheet discharged from the sheet discharge portion is loaded on the sheet loading portion. The ribs each have a sloped part that tapers downward to an upstream side in the discharge direction. The ribs protrude upward from the sheet loading portion along the discharge direction. The actuator includes a shaft and a contact piece. The shaft is disposed above the sheet loading portion, and extends in a sheet width direction intersecting the discharge direction. The contact piece extends from the shaft to the sheet loading portion, in a position where the ribs are not disposed in the sheet width direction. The contact piece rotates integrally with the shaft when the sheet discharged to the sheet loading portion comes into contact with the contact piece. The sheet detecting portion detects a first state, a second state, and a third state in accordance with the rotation of the contact piece about the shaft. In the first state, no sheet is loaded on the sheet loading portion. In the second state, one sheet discharged from the sheet discharge portion is loaded on the sheet loading portion. In the third state, sheets as many as a predetermined number of sheets regarded as a full load state are loaded on the sheet loading portion. In the first state, the contact piece is positioned at a stand-by position in which a tip of the contact piece is extended so as to be lower than an upper edge of the rib.

An image forming apparatus according to another aspect of the present disclosure includes an image forming portion, and a sheet loading device. The image forming portion forms an image on a sheet. The sheet on which the image is formed is discharged to the sheet loading device. The sheet loading device includes a housing, a sheet discharge portion, a sheet loading portion, a plurality of ribs, an actuator, and a sheet detecting portion. The sheet discharge portion discharges a sheet in a predetermined discharge direction. The sheet loading portion is disposed in the housing. The sheet discharged from the sheet discharge portion is loaded on the sheet loading portion. The ribs each have a sloped part that tapers downward to an upstream side in the discharge direction. The ribs protrude upward from the sheet loading portion along the discharge direction. The actuator include a shaft and a contact piece. The shaft is disposed above the sheet loading portion, and extends in a sheet width direction intersecting the discharge direction. The contact piece extends from the shaft to the sheet loading portion, in a position where the ribs are not disposed in the sheet width direction. The contact piece rotates integrally with the shaft when the sheet discharged to the sheet loading portion comes into contact with the contact piece. The sheet detecting portion detects a first state, a second state, and a third state in accordance with the rotation of the contact piece about the shaft. In the first state, no sheet is loaded on the sheet loading portion. In the second state, one sheet discharged from the sheet discharge portion is loaded on the sheet loading portion. In the third state, sheets as many as a predetermined number of sheets regarded as a full load state are loaded on the sheet loading portion. In the first state, the contact piece is positioned at a stand-by position in which a tip of the contact piece is extended so as to be lower than an upper edge of the rib.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
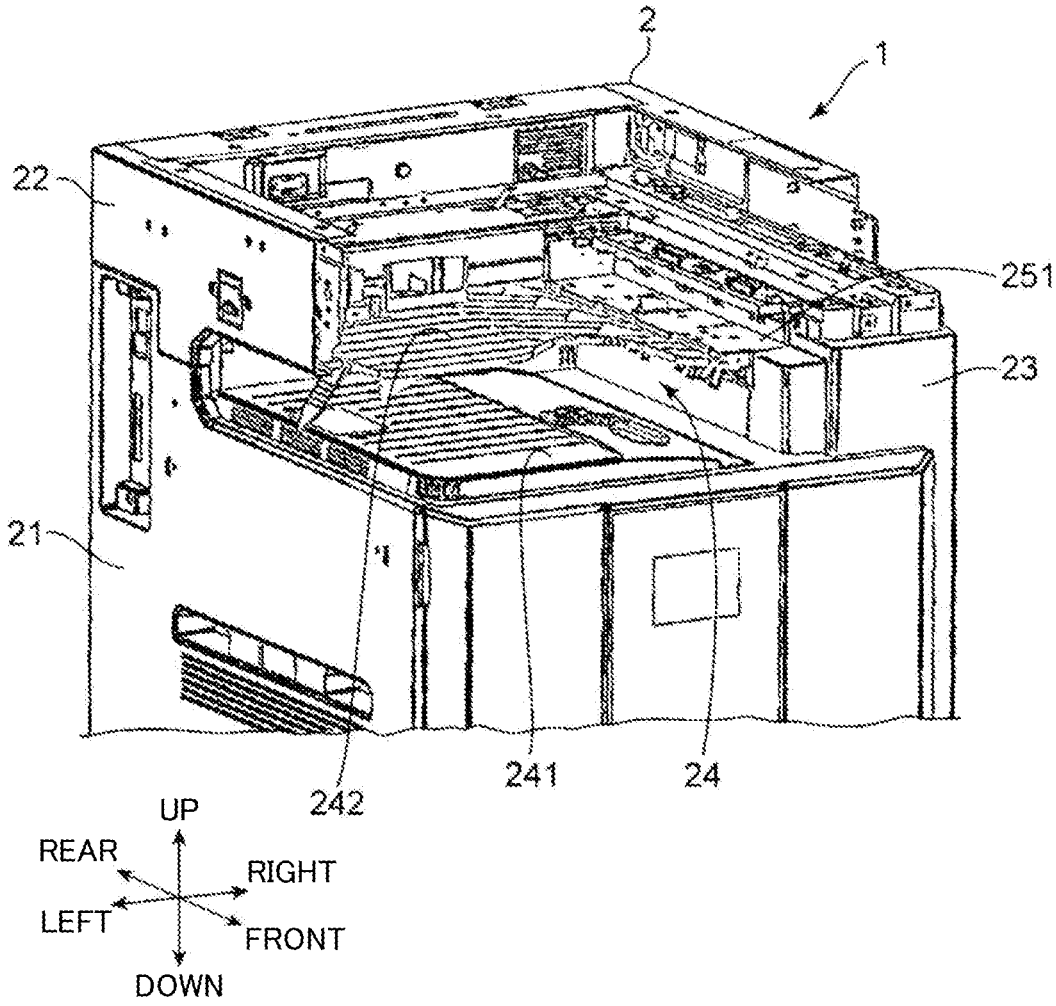
FIG. 1 is a perspective view showing an image forming apparatus according to an embodiment of the present disclosure.
Figure 2:
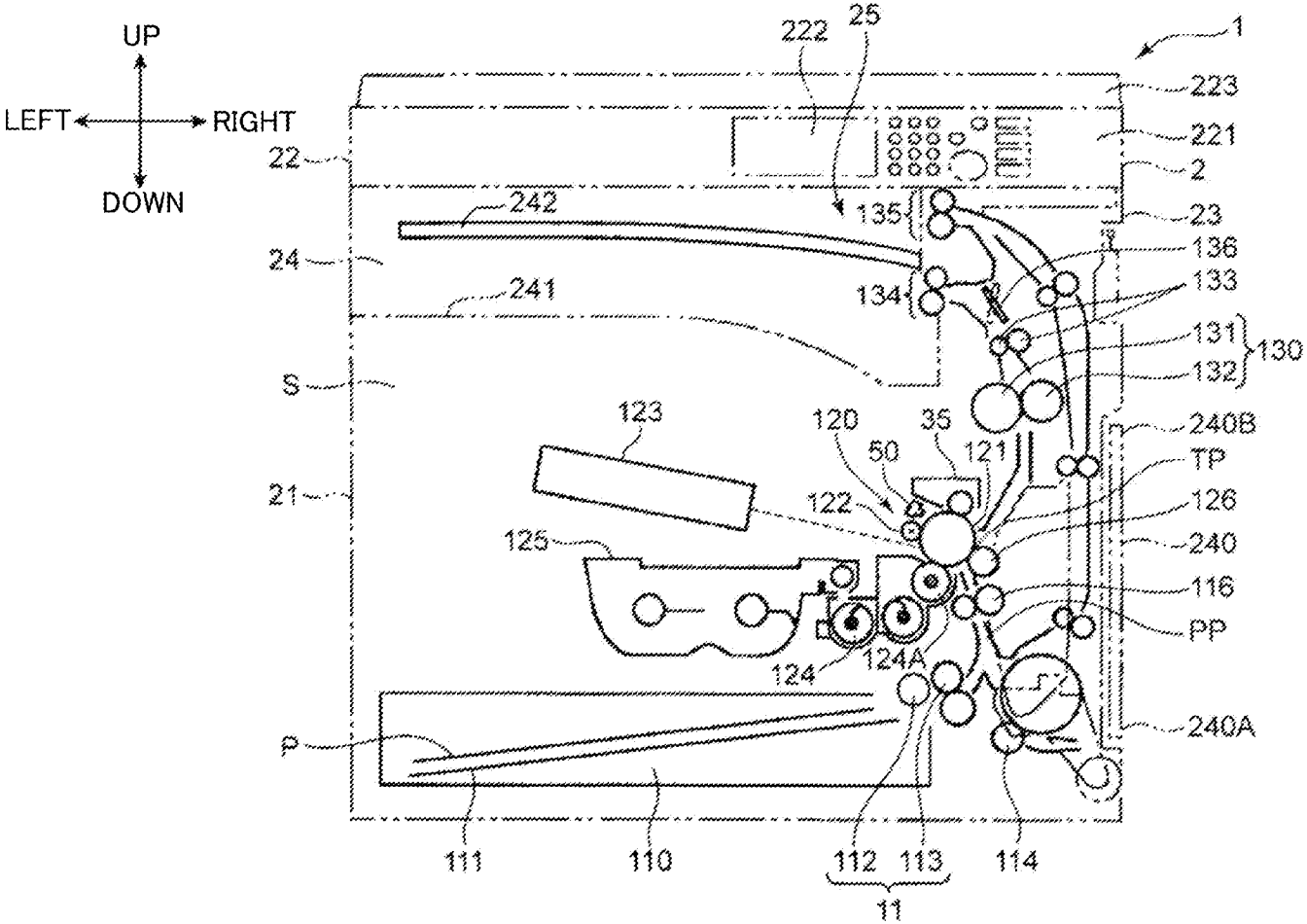
FIG. 2 is a cross-sectional view showing an internal structure of the image forming apparatus shown in FIG. 1.

Hereinafter, an embodiment of the present disclosure will be described in detail with reference to the drawings. FIG. 1 is an external perspective view of an image forming apparatus 1 according to an embodiment of the present disclosure. In FIG. 1, an upper housing 22 described later is partially cut away. FIG. 2 is a cross-sectional view showing an internal structure of the image forming apparatus 1.

The image forming apparatus 1 shown in FIGS. 1 and 2 is a so-called monochrome multifunction peripheral. Alternatively, in another embodiment, the image forming apparatus may be an apparatus other than the monochrome multifunction peripheral, which is capable of forming a toner image and/or an ink image on a sheet, such as a color multifunction peripheral, a color printer, a facsimile device, or the like.

It is noted that the terms expressing directions, such as "up" and/or "down", "front" and/or "rear", and "left" and/or "right" used in the following description, are used merely for descriptive purposes to provide a better understanding, and do not intend to limit the principle of the image forming apparatus.

Further, in the following description, the term "sheet" refers to copy paper, coated paper, OHP sheet, cardboard, postcard, tracing paper, and other sheet materials to be subject to an image forming process, or sheet materials to be subject to arbitrary processes other than the image forming process.

The image forming apparatus 1 has a normal operation mode and an energy saving mode (sleep mode). When the image forming apparatus 1 does not perform an image forming operation, the energy saving mode can be selected. In the energy saving mode, power consumption of the image forming apparatus 1 is suppressed to a minimum level at which only part of a control board is driven.

The image forming apparatus 1 includes a substantially rectangular-parallelepiped-shaped main housing 2. The main housing 2 includes a substantially rectangular-parallelepiped-shaped lower housing 21, a substantially rectangular-parallelepiped-shaped upper housing 22 disposed above the lower housing 21, and a connection housing 23 connecting the lower housing 21 and the upper housing 22 (housing). The connection housing 23 extends along a right edge and a rear edge of the main housing 2. Sheets subjected to a printing process are discharged to a discharge space 24 enclosed by the lower housing 21, the upper housing 22, and the connection housing 23. Particularly in the present embodiment, the sheets are discharged to a sheet discharge plane 241 disposed on an upper surface of the lower housing 21 and to a sheet discharge tray 242 disposed above the sheet discharge plane 241.

By the way, the above-mentioned conventional art may have the following problems. That is, if sheets are bent when discharged to the sheet discharge portion and thereby alignment of the sheets is deteriorated (i.e., if curl occurs), the actuator is not pressed downward, whereby the sheet discharge state cannot be accurately detected. Further, when movement of the filler that is turned when pressed against the sheets is detected by a plurality of photointerrupters, since the photointerrupters are in the current conducting states, power consumption is increased. Particularly when presence/absence of sheets is detected in the sleep mode of the image forming apparatus, the photointerrupters need to be set in the current conducting states, which causes the above problem. Moreover, when a movement range of the filler pressed against the sheets is ensured, the length of the filler needs to be set long. As a result, excessive load is applied to the sheets discharged by the filler, whereby alignment of the sheets is deteriorated. In contrast to the conventional art, in the image forming apparatus 1, a state where one sheet is discharged onto the sheet discharge tray 242 and a state where the sheet discharge tray 242 is fully loaded with sheets are detected by a common contact piece 71 described later, and alignment of the sheets is ensured.

An operation portion 221 disposed on a front surface of the upper housing 22 includes, for example, an LCD touch panel 222 (lighting portion). The operation portion 221 is formed to enable input of information relating to the image forming process. For example, a user can input the number of sheets to be printed, the density of printing, and the like by using the LCD touch panel 222. Further, various kinds of notification messages to the user are displayed on the LCD touch panel 222. The upper housing 22 mainly houses equipment for reading images from document sheets and/or an electronic circuit for controlling the entire image forming apparatus 1.

A pressing cover 223 disposed on the upper housing 22 is used for holding down a document sheet. The pressing cover 223 is mounted on the upper housing 22 in a vertically turnable manner. The user turns the pressing cover 223 upward and puts a document sheet on the upper housing 22. Thereafter, the user operates the operation portion 221 to cause the equipment disposed in the upper housing 22 to read an image on the document sheet.

A manual feed tray 240 (FIG. 2) is disposed on the right side surface of the lower housing 21. An upper end 240B side of the manual feed tray 240 is vertically turnable with a lower end 240A thereof as a fulcrum point. When the manual feed tray 240 is turned downward and positioned so as to protrude rightward from the lower housing 21, the user can place sheets on the manual feed tray 240. Based on an instruction input by the user via the operation portion 221, a sheet on the manual feed tray 240 is drawn into the lower housing 21, and thereafter, subjected to the image forming process, and discharged to the discharge space 24. Further, an internal space S in which various kinds of devices described later are disposed is formed in the lower housing 21 (FIG. 2).

The image forming apparatus 1 includes, in the internal space S, a cassette 110, a sheet feed portion 11, a second sheet feed roller 114, a registration roller pair 116, and an image forming portion 120. The sheet feed portion 11 includes a pickup roller 112 and a first sheet feed roller 113. The sheet feed portion 11 feeds a sheet P to a sheet conveying path PP. The sheet conveying path PP is provided from the sheet feed portion 11 to pass through the registration roller pair 116 and a transfer position TP provided in the image forming portion 120.

The cassette 110 contains sheets P. The cassette 110 can be pulled out from the lower housing 21 in the frontward direction (in the direction to the near side on the paper surface of FIG. 2). A sheet P contained in the cassette 110 is fed upward in the lower housing 21. Thereafter, the sheet P is subjected to the image forming process in the lower housing 21 based on an instruction input by the user via the operation portion 221, and discharged to the discharge space 24. The cassette 110 includes a lift plate 111 that supports the sheets P. The lift plate 111 is tilted so as to lift the leading edges of the sheets P upward.

The pickup roller 112 is disposed above the leading edges of the sheets P lifted upward by the lift plate 111. When the pickup roller 112 is rotated, the sheets P are sequentially drawn out from the cassette 110.

The first sheet feed roller 113 is disposed downstream of the pickup roller 112 in the sheet conveying direction. The first sheet feed roller 113 feeds the sheet P further to the downstream side in the sheet conveying direction. The second sheet feed roller 114 is disposed inward with respect to the lower end 240A of the manual feed tray 240. The second sheet feed roller 114 conveys the sheet P on the manual feed tray 240 into the lower housing 21. The user can selectively use the sheets P contained in the cassette 110 or the sheets P placed on the manual feed tray 240.

The registration roller pair 116 defines the position of a sheet P in a direction perpendicular to the sheet conveying direction. Thereby, the position of an image formed on the sheet P is adjusted. The registration roller pair 116 forms a nip part between the rollers. The registration roller pair 116 conveys the sheet P to the image forming portion 120 at a timing when a toner image is transferred on the sheet P in the image forming portion 120. Further, the registration roller pair 116 has a function of correcting skew of the sheet P.

The image forming portion 120 includes a photosensitive drum 121, a charger 122, an exposure device 123, a developing device 124, a toner container 125, a transfer roller 126, a cleaning device 35, and an electricity removing device 50. The photosensitive drum 121, the charger 122, and the cleaning device 35 are integrally disposed in a drum unit (not shown).

The photosensitive drum 121 has a substantially cylindrical shape. The photosensitive drum 121 has a circumferential surface on which an electrostatic latent image is formed, and carries a toner image according to the electrostatic latent image.

The charger 122 is supplied with a predetermined voltage, and charges the circumferential surface of the photosensitive drum 121 substantially uniformly. The exposure device 123 emits a laser beam to the circumferential surface of the photosensitive drum 121 charged by the charger 122. The laser beam is emitted in accordance with image data that is output from an external device (not shown) such as a personal computer communicably connected to the image forming apparatus 1. As a result, an electrostatic latent image corresponding to the image data is formed on the circumferential surface of the photosensitive drum 121.

The developing device 124 supplies a toner to the circumferential surface of the photosensitive drum 121 on which the electrostatic latent image is formed. The toner container 125 supplies the toner to the developing device 124. The toner container 125 supplies the toner to the developing device 124 sequentially or according to need. When the developing device 124 supplies the toner to the photosensitive drum 121, the electrostatic latent image formed on the circumferential surface of the photosensitive drum 121 is developed (visualized). As a result, a toner image is formed on the circumferential surface of the photosensitive drum 121. The developing device 124 includes a developing roller 124A that holds the toner on its circumferential surface. The developing roller 124A is, in the development position, disposed so as to oppose the photosensitive drum 121. The developing roller 124A is rotationally driven, and supplies the toner to the photosensitive drum 121.

The transfer roller 126 is, in the transfer position TP, disposed so as to oppose the circumferential surface of the photosensitive drum 121. In the transfer position TP, the transfer roller 126 is rotationally driven in the same direction as the photosensitive drum 121. In the transfer position TP, the toner image formed on the circumferential surface of the photosensitive drum 121 is transferred to the sheet P.

The cleaning device 35 removes the residual toner on the circumferential surface of the photosensitive drum 121 after the toner image has been transferred to the sheet P. The electricity removing device 50 emits predetermined electricity removing light to the photosensitive drum 121 whose circumferential surface has been cleaned by the cleaning device 35. As a result, the potential on the circumferential surface of the photosensitive drum 121 is made uniform.

The circumferential surface of the photosensitive drum 121, cleaned by the cleaning device 35 and then subjected to the electricity removal by the electricity removing device 50, is again uniformly charged while passing beneath the charger 122. Thereafter, the above-mentioned formation of a toner image is newly performed.

The image forming apparatus 1 further includes, on the downstream side in the conveying direction with respect to the image forming portion 120, a fixing device 130 that fixes the toner image on the sheet P. The fixing device 130 includes a heating roller 131 for melting the toner on the sheet P, and a pressure roller 132 for bringing the sheet P in close contact with the heating roller 131. When the sheet P has passed between the heating roller 131 and the pressure roller 132, the toner image is fixed to the sheet P.

The image forming apparatus 1 further includes a conveying roller pair 133 disposed downstream of the fixing device 130, and a switching portion 136, a lower discharge roller pair 134, and an upper discharge roller pair 135 which are disposed downstream of the conveying roller pair 133. The conveying roller pair 133 conveys the sheet P subjected to the fixing process by the fixing device 130, to the downstream side in the sheet conveying direction. The switching portion 136 has a function of switching the sheet P conveying direction, on the downstream side in the sheet conveying direction with respect to the conveying roller pair 133. The lower discharge roller pair 134 is disposed to the left of the switching portion 136, and discharges, to the sheet discharge plane 241, the sheet P conveyed by the conveying roller pair 133. The upper discharge roller pair 135 is disposed above the lower discharge roller pair 134, and discharges the sheet P conveyed by the conveying roller pair 133, to an upper discharge plane 26 including the sheet discharge tray 242 mounted above the sheet discharge plane 241.

Figure 3:
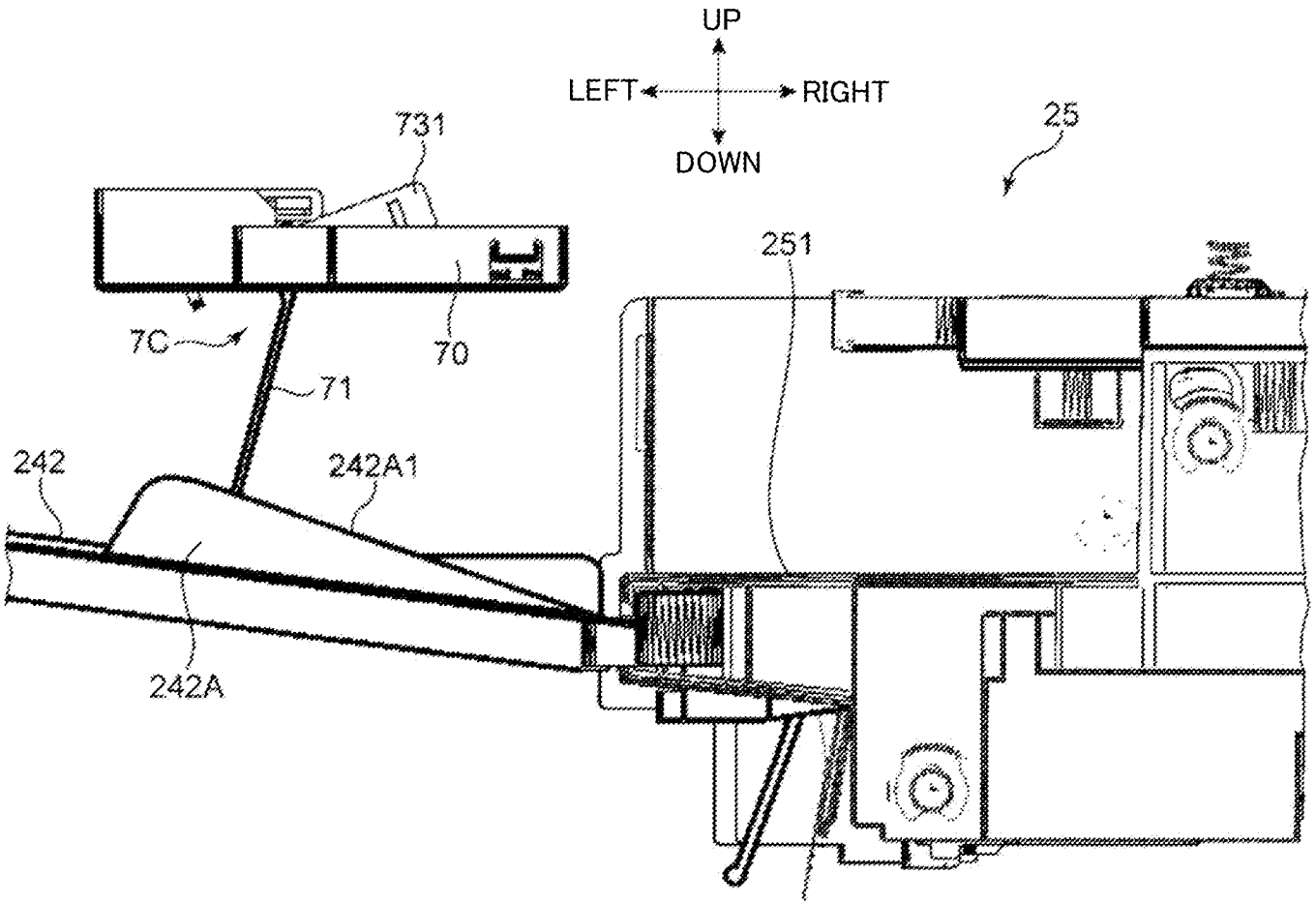
FIG. 3 is a front view of an upper discharge portion, in a first state, of the image forming apparatus shown in FIG. 1.
Figure 4:
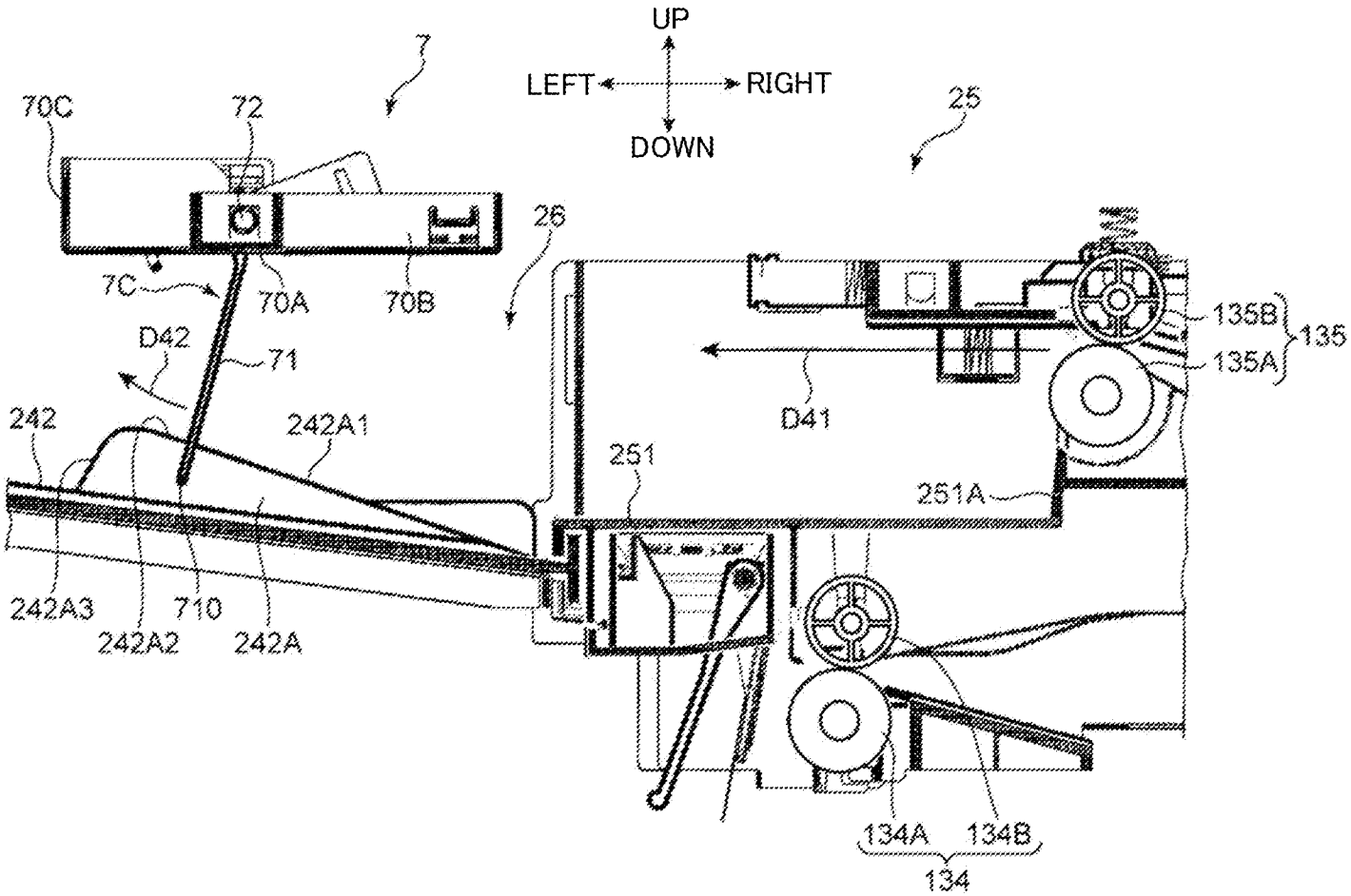
FIG. 4 is a cross-sectional view of the upper discharge portion of the image forming apparatus shown in FIG. 1.

Hereinafter, an upper discharge portion 25 to which sheets are discharged from the upper discharge roller pair 135 will be described in detail with reference to FIGS. 3 and 4. FIG. 3 and FIG. 4 are a front view and a cross-sectional view of the upper discharge portion 25, respectively.

The above-mentioned upper discharge roller pair 135 discharges a sheet P in a sheet discharge direction indicated by arrow D41 in FIG. 4. The sheet P discharged from the upper discharge roller pair 135 is loaded on the upper discharge plane 26 (sheet loading portion, refer to FIG. 4). The upper discharge plane 26 is composed of the sheet discharge tray 242 and an upper plate 251. The upper plate 251 is a part of the connection housing 23. The sheet discharge tray 242 is detachably mounted on a left end part of the upper plate 251. A plurality of discharge ribs 242A are disposed on an upper surface of the sheet discharge tray 242. Each discharge rib 242A is a rib member having a substantially triangular shape. The plurality of discharge ribs 242A are disposed spaced apart from each other in the front-rear direction. The discharge ribs 242A are disposed along the sheet discharge direction (direction of arrow D41 in FIG. 4) so as to protrude upward from the sheet discharge tray 242. The discharge ribs 242A have a function of aligning the trailing edges of a plurality of sheets P discharged from the upper discharge roller pair 135. For this purpose, each discharge rib 242A has a sloped part 242A1 that tapers downward to the upstream side in the sheet discharge direction.

In the present embodiment, the upper discharge portion 25 (FIG. 2, sheet loading device) is composed of the upper discharge roller pair 135, the upper discharge plane 26, and an actuator 7C and a sheet detecting portion 7 which are described later. The upper discharge portion 25 is able to function as a so-called job separator. That is, when an image is formed on the back side of a sheet P in both-side printing, the sheet P whose front side has been subjected to the fixing process is temporarily discharged to the upper discharge portion 25 and thereafter switched back to be conveyed to the image forming portion 120 again. Alternatively, a sheet P on which an image has been formed by a copy/print function may be discharged to the sheet discharge plane 241 while a sheet P on which an image has been formed by a FAX function may be selectively discharged to the upper discharge portion 25.

Figure 5:
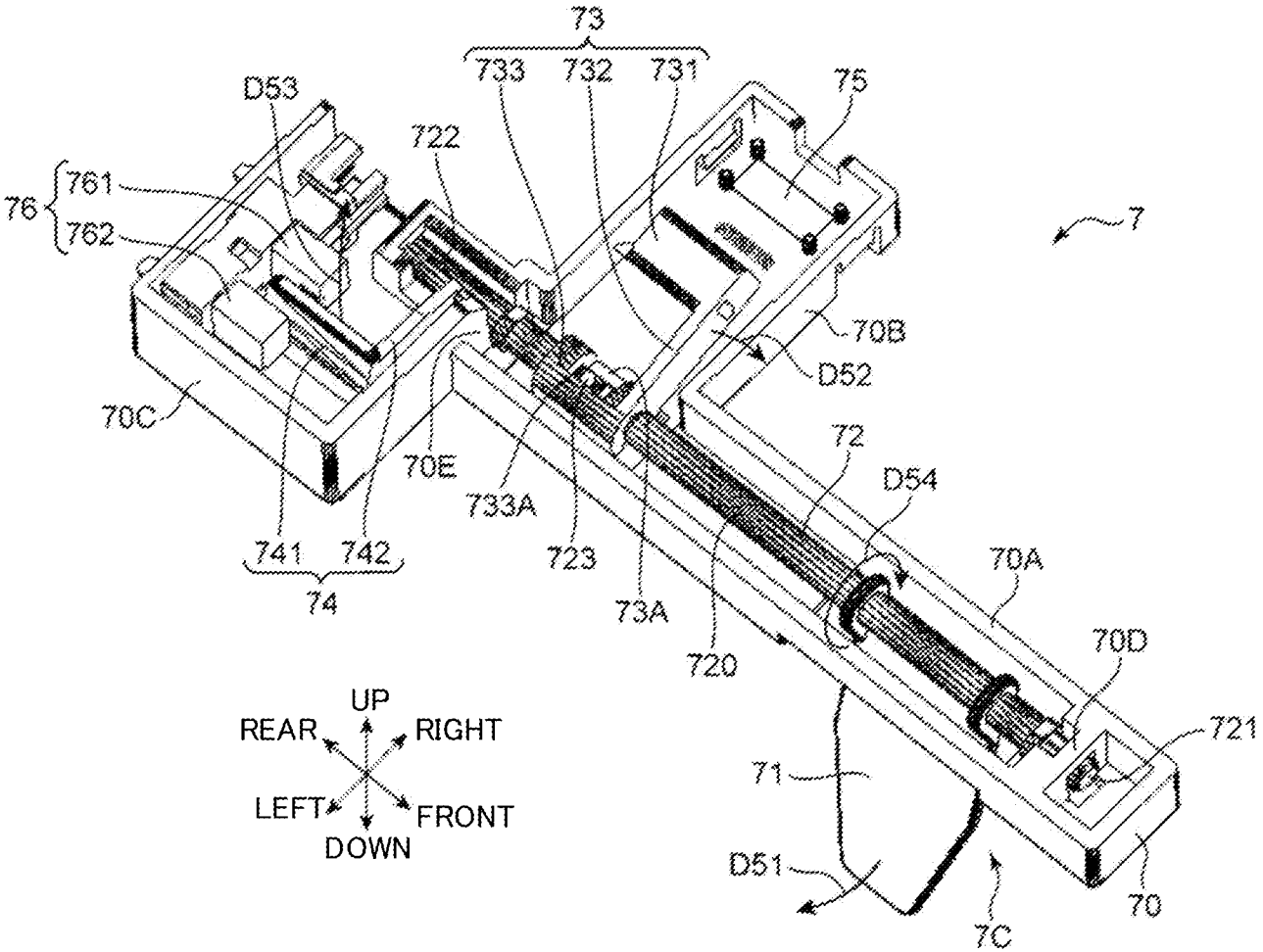
FIG. 5 is a perspective view showing a sheet detecting portion of the image forming apparatus shown in FIG. 1.
Figure 6:
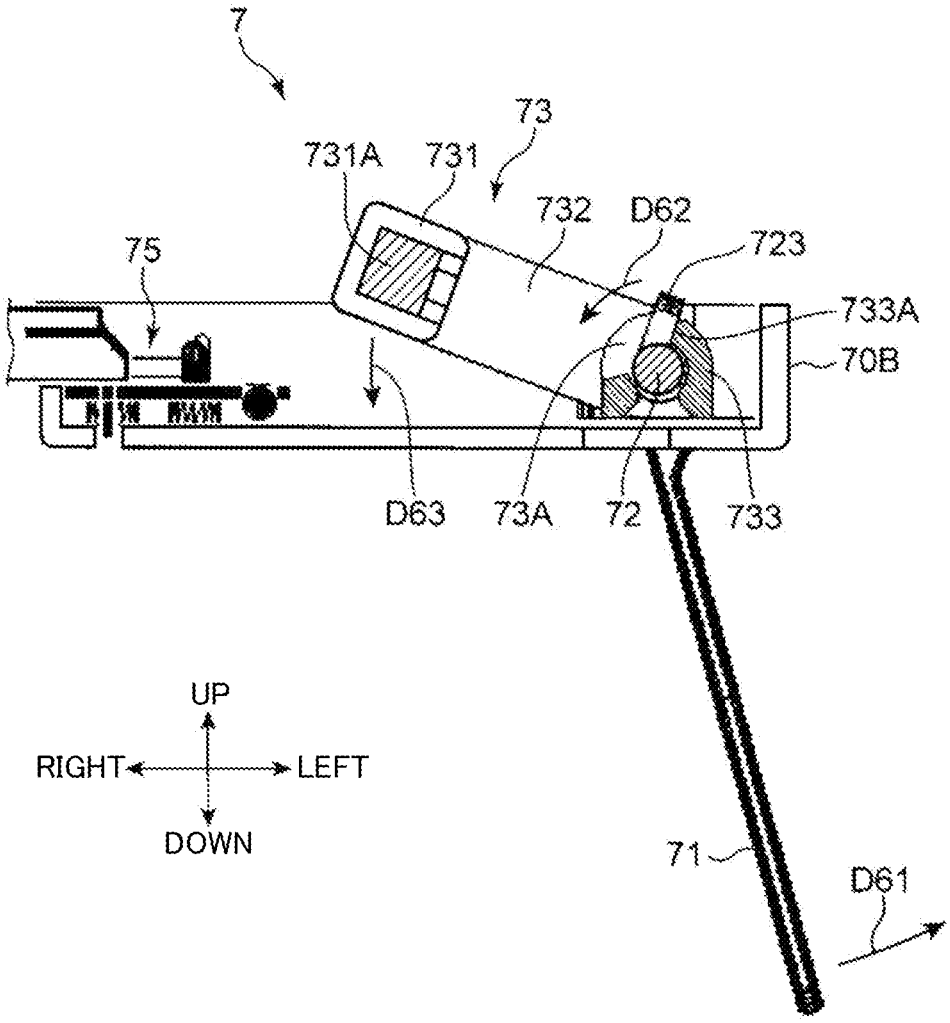
FIG. 6 is a cross-sectional view of a first sheet detecting portion of the sheet detecting portion of the image forming apparatus shown in FIG. 1.

Hereinafter, the actuator 7C and the sheet detecting portion 7 disposed in the upper discharge portion 25 will be described in detail with reference to FIGS. 5 and 6 as well as FIGS. 3 and 4. FIG. 5 is a perspective view showing the actuator 7C and the sheet detecting portion 7 according to the present embodiment. FIG. 6 is a cross-sectional view showing the actuator 7C and the sheet detecting portion 7.

The actuator 7C is disposed above and spaced apart from the upper discharge plane 26 (sheet discharge tray 242). The actuator 7C includes a contact piece 71 and a shaft 72. The shaft 72 is disposed above the sheet discharge tray 242 so as to extend in a sheet width direction perpendicular to the sheet discharge direction. The shaft 72 serves as a rotation shaft for rotation of the contact piece 71 and rotations of a first detection piece 73 and a second detection piece 74 which are described later.

The contact piece 71 extends from the shaft 72 toward the sheet discharge tray 242. The contact piece 71 is rotatable about the shaft 72 when a sheet P discharged to the upper discharge plane 26 comes into contact with the contact piece 71. At this time, the contact piece 71 rotates integrally with the shaft 72. It is noted that the plurality of discharge ribs 242A mentioned above are disposed spaced apart from each other in the sheet width direction. The contact piece 71 is disposed between two adjacent discharge ribs 242A in the sheet width direction among the plurality of discharge ribs 242A. In other words, the contact piece 71 extends from the shaft 72 toward the sheet discharge tray 242 at a position where the discharge ribs 242A are absent in the sheet width direction.

The sheet detecting portion 7 supports the actuator 7C. The sheet detecting portion 7 is disposed above and spaced apart from the sheet discharge tray 242. The sheet detecting portion 7 detects, in accordance with the rotation of the contact piece 71 about the shaft 72, a first state where no sheet P is placed on the upper discharge plane 26, a second state where one sheet P discharged from the upper discharge roller pair 135 is placed on the upper discharge plane 26, and a third state where sheets P as many as a predetermined number of sheets regarded as a full load state are placed on the upper discharge plane 26.

The sheet detecting portion 7 includes a housing 70, a first detection piece 73, a second detection piece 74, a reed switch 75 (first sheet detecting portion), and a photointerrupter 76 (second sheet detecting portion).

The housing 70 is a casing that supports the respective components of the sheet detecting portion 7. Further, the housing 70 rotatably supports the shaft 72 of the actuator 7C. The housing 70 extends in the sheet width direction (front-rear direction). The housing 70 includes a first housing 70A, a second housing 70B, and a third housing 70C. The first housing 70A is a front-side part of the housing 70, and is a box-shaped member extending in the front-rear direction.

The first housing 70A supports the actuator 7C. As shown in FIG. 5, a first bearing 70D and a second bearing 70E are disposed at both ends of the first housing 70A in the front-rear direction, respectively. The shaft 72 is rotatably supported by the first bearing 70D and the second bearing 70E. The contact piece 71 is inserted through a hole (not shown) opened at the bottom of the first housing 70A, and is extended downward from the shaft 72.

The second housing 70B is a box-shaped member extending rightward at the rear side of the first housing 70A. The second housing 70B houses the first detection piece 73 and the reed switch 75 which are described later. Further, the third housing 70C is a box-shaped member extending leftward at the rear side end of the first housing 70A. The third housing 70C houses the second detection piece 74 and the photointerrupter 76 which are described later. The internal spaces of the first housing 70A, the second housing 70B, and the third housing 70C are communicated with each other.

The first detection piece 73 is disposed on the front side of the second bearing 70E so as to extend from the shaft 72 in the radial direction of the shaft 72. The first detection piece 73 extends from the shaft 72 in substantially rightward direction. In the transition from the first state to the second state, the first detection piece 73 is rotatable together with the shaft 72. Further, in the transition from the second state to the third state, the first detection piece 73 is rotatable relative to the shaft 72. In other words, the shaft 72 is rotatable with the first detection piece 73 being fixed. When the first detection piece 73 is detected by the reed switch 75, the second state is detected. The first detection piece 73 includes an end part 731, a first support part 732, and a cylindrical part 733.

The cylindrical part 733 is a cylindrical member externally fitted to the shaft 72. The cylindrical part 733 is rotatable relative to the shaft 72. The cylindrical part 733 has an opening 73A. The opening 73A is opened at a circumferential surface of the cylindrical part 733, and has a predetermined opening length in the circumferential direction of the shaft 72. It is noted that the above-mentioned shaft 72 has a circumferential surface 720, and further has a projection part 723 opposed to the opening 73A. The projection part 723 is a projection projecting from the shaft 72 in the radial direction of the shaft 72, and is inserted through the opening 73A.

The first support part 732 is a plate member extending from a front-side end of the cylindrical part 733 in the radial direction of the shaft 72. The end part 731 is fixed to an outer side, in the radial direction, of the first support part 732. The end part 731 is a box-shaped member extending in the front-rear direction. The end part 731 contains a magnet 731A (FIG. 6) (magnetic member). When the first detection piece 73 is rotated about the shaft 72, the end part 731 comes into contact with the bottom of the second housing 70B.

The reed switch 75 is disposed on the right-side end of the second housing 70B. The reed switch 75 detects the first state and the second state in accordance with the rotation of the first detection piece 73. The reed switch 75 is electrically connected to a control portion (not shown) disposed inside the connection housing 23. The reed switch 75 contains a dielectric coil. The current conducting state of the reed switch 75 varies in association with approach of the magnet 731A of the first detection piece 73. That is, when the first detection piece 73 is disposed above the reed switch 75 as shown in FIG. 5, current conduction to the internal circuit of the reed switch 75 is cut off. On the other hand, when the first detection piece 73 is rotated in the direction of arrow D52 shown in FIG. 5 or in the direction of arrow D63 shown in FIG. 6 and thereby the magnet 731A gets close to the reed switch 75, the internal circuit of the reed switch 75 is set in the current conducting state. With this current conducting state, the control portion detects that the first detection piece 73 gets close to the reed switch 75. That is, the first state and the second state are appropriately detected when the magnet 731A of the first detection piece 73 moves away from and gets close to the reed switch 75.

It is noted that, even in the energy saving mode of the image forming apparatus 1, if a sheet remains on the upper discharge portion 25, this state (second state) needs to be informed to the user. In the present embodiment, the reed switch 75 is adopted to detect this state. Therefore, in the energy saving mode of the image forming apparatus 1, current conduction to the reed switch 75 is not needed, whereby the energy saving effect of the image forming apparatus 1 is more enhanced. That is, since the second state is detected by the reed switch 75, power consumption of the image forming apparatus 1 is reduced as compared to the case where a photointerrupter that consumes relatively large power is used.

The second detection piece 74 is connected to the shaft 72, at the rear side of the second bearing 70E. The second detection piece 74 extends from the shaft 72 in the radial direction of the shaft 72, and is rotated integrally with the shaft 72. The second detection piece 74 extends from the shaft 72 in substantially leftward direction that is opposite to the direction along which the first detection piece 73 extends. The second detection piece 74 includes a light blocking part 741 and a second support part 742. The second support part 742 is a plate member extending from the shaft 72. The light blocking part 741 extends rearward from an outer end, in the radial direction, of the second support part 742. The light blocking part 741 is a plate member having a substantially arc shape when viewed at a cross section intersecting the axial direction of the shaft 72 (refer to FIG. 10). The light blocking part 741 of the second detection piece 74 is inserted between a light-emitting part 761 and a light-receiving part 762 of the photointerrupter 76 described later.

The photointerrupter 76 detects the above-mentioned third state in accordance with rotation of the second detection piece 74 about the shaft 72. The photointerrupter 76 includes the light-emitting part 761 and the light-receiving part 762. Predetermined detection light is emitted from the light-emitting part 761, and the detection light can be received by the light-receiving part 762. When the light blocking part 741 of the second detection piece 74 is inserted between the light-emitting part 761 and the light-receiving part 762, the detection light is blocked. On the other hand, when the light blocking part 741 moves upward and away from the space between the light-emitting part 761 and the light-receiving part 762 in association with rotation of the second detection piece 74 about the shaft 72, the detection light is received by the light-receiving part 762. That is, when the second detection piece 74 moves away from the photointerrupter 76, the third state is appropriately detected. The photointerrupter 76 outputs a HIGH signal and a LOW signal to the control portion (not shown) in accordance with change in the blocking state of the detection light. As a result, the detection state of the second detection piece 74 is changed. That is, rotations of the first detection piece 73 and the second detection piece 74 about the shaft 72 enable appropriate detection of the first, second, and third states.

Figure 7:
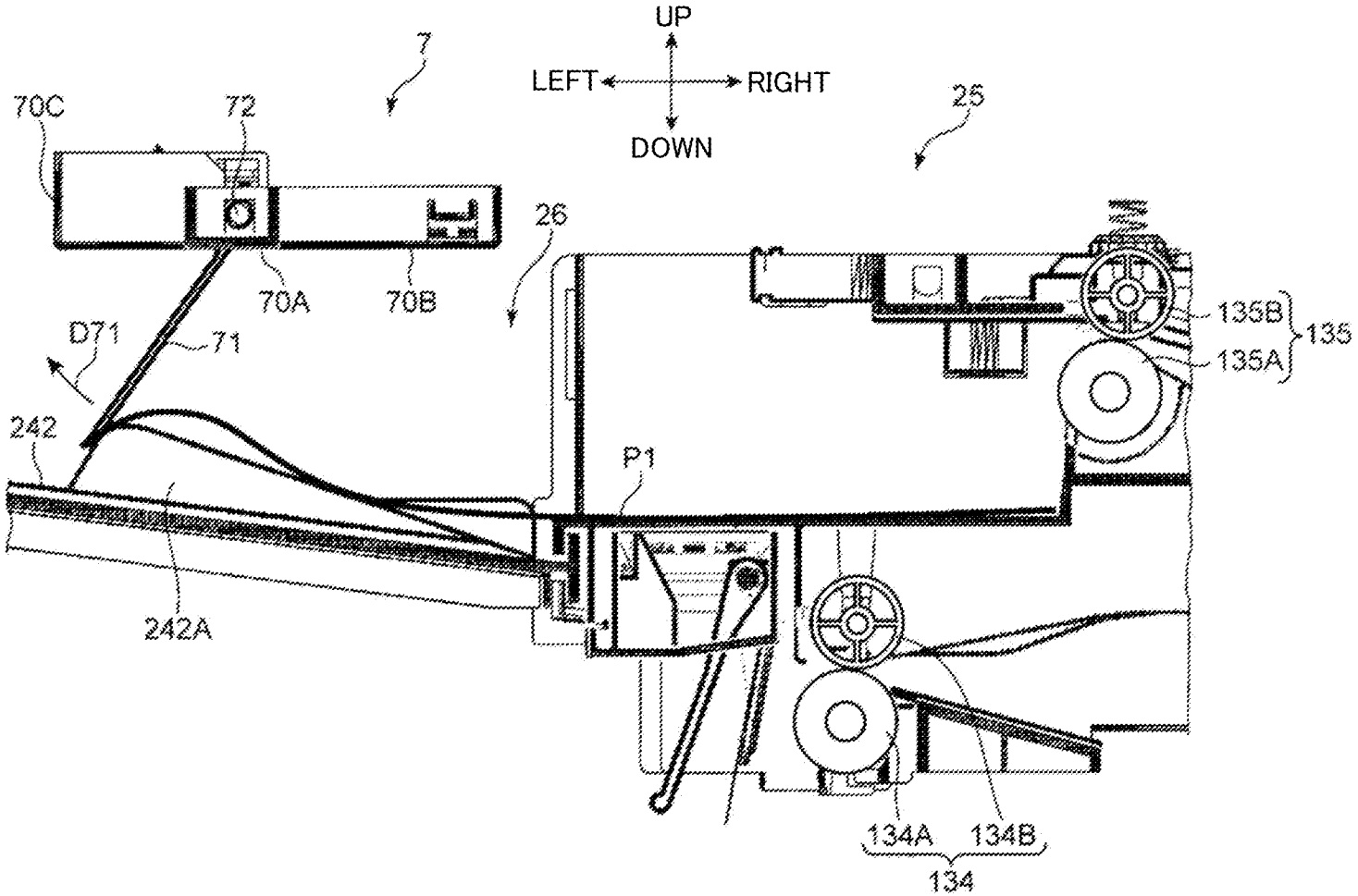
FIG. 7 is a cross-sectional view showing a state (second state) where one sheet is discharged to the upper discharge portion of the image forming apparatus shown in FIG. 1.
Figure 8:
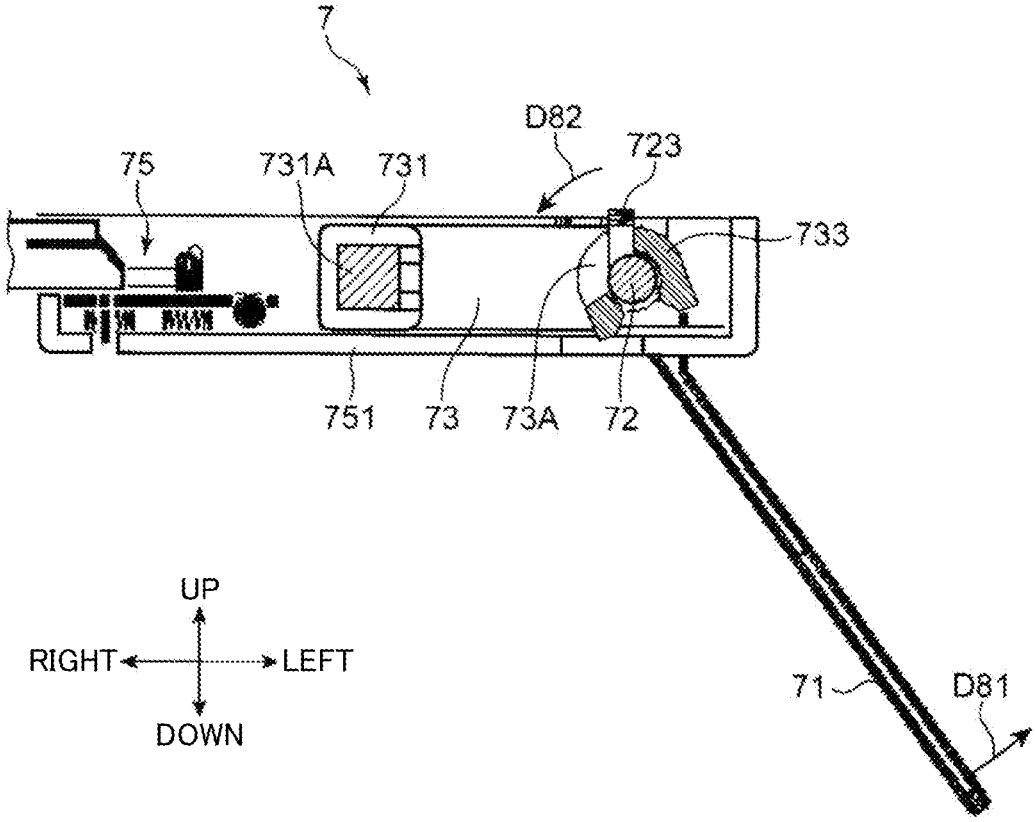
FIG. 8 is a cross-sectional view of the first sheet detecting portion in the state shown in FIG. 7.
Figure 9:
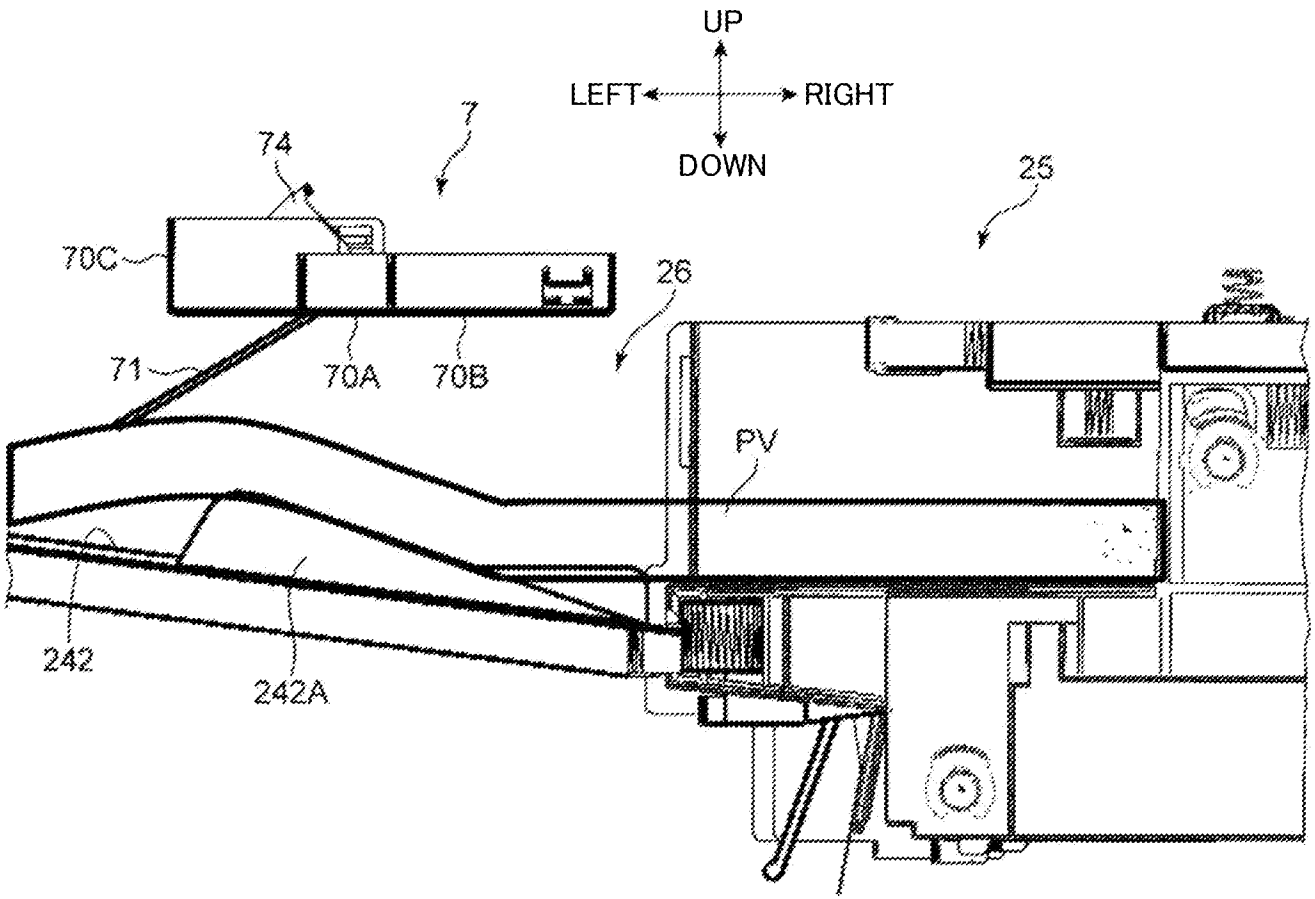
FIG. 9 is a cross-sectional view showing a state (third state) where the upper discharge portion of the image forming apparatus shown in FIG. 1 is fully loaded with sheets.
Figure 10:
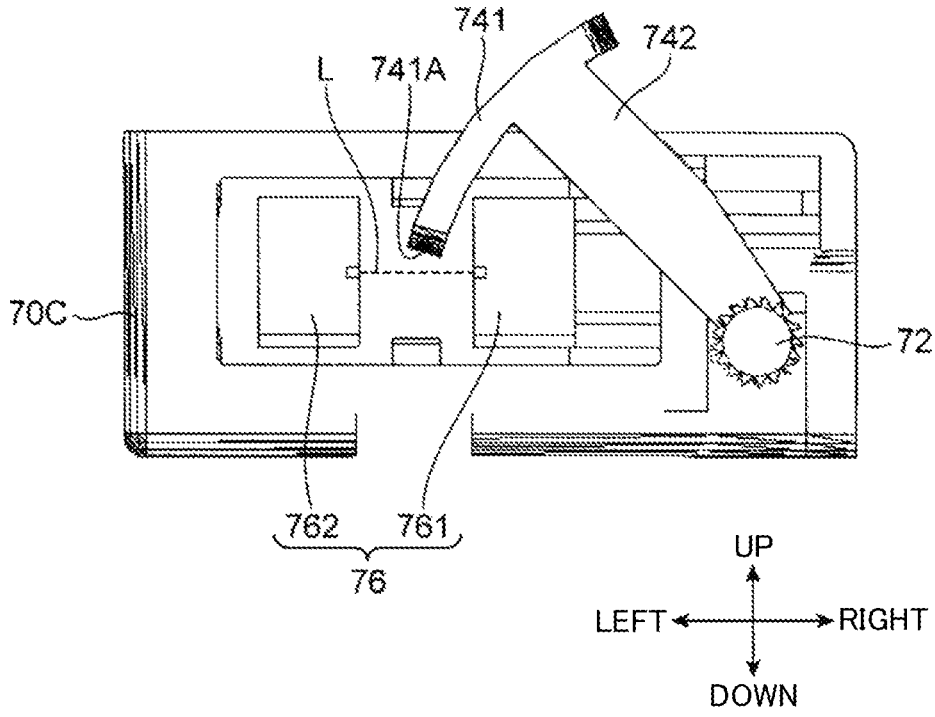
FIG. 10 is a front view of a second sheet detecting portion in the state shown in FIG. 9.

Next, a manner of detecting the state of a sheet P on the upper discharge plane 26 by the actuator 7C and the sheet detecting portion 7 of the present embodiment will be described. The above-mentioned FIGS. 4 and 6 correspond to the first state where no sheet P is discharged to the upper discharge plane 26. FIG. 7 is a cross-sectional view of the upper discharge portion 25, indicating the second state where one sheet P is discharged to the upper discharge plane 26. FIG. 8 is a cross-sectional view of the sheet detecting portion 7 in the state shown in FIG. 7. Further, FIG. 9 is a cross-sectional view of the upper discharge portion 25 in the third state where sheets P as many as the number of sheets corresponding to the full load state are discharged and loaded on the upper discharge plane 26. In the present embodiment, it is predetermined that 50 sheets P correspond to the full load state. Further, FIG. 10 is a cross-sectional view showing the photointerrupter 76 and its vicinity in the third state.

In the first state where no sheet P is placed on the upper discharge plane 26, the contact piece 71 is positioned at a stand-by position shown in FIG. 4. In the stand-by position, a lower end 710 (tip) of the contact piece 71 is extended downward to a position lower than an upper edge 242A2 of the discharge rib 242A. In other words, in a cross section intersecting the sheet width direction, the contact piece 71 and the discharge rib 242A overlap each other in the vertical direction. The contact piece 71 is disposed at a predetermined distance in the left-right direction from a rear edge 242A3 of the discharge rib 242A. In the first state, as shown in FIGS. 5 and 6, the first detection piece 73 is disposed above and to the left of the reed switch 75 so as to be apart from the reed switch 75. This is because the projection part 723 projecting from the shaft 72 is in contact with a wall surface 733A that is an edge part on one end side of the opening 73A in the circumferential direction of the cylindrical part 733, among the edge parts of the opening 73A. Therefore, current conduction to the reed switch 75 is blocked. Further, as shown in FIG. 5, the light blocking part 741 of the second detection piece 74 is disposed between the light-emitting part 761 and the light-receiving part 762 of the photointerrupter 76. Therefore, the detection light from the photointerrupter 76 is blocked by the light blocking part 741.

In the image forming apparatus 1, after an image is formed on a sheet P1, the sheet P1 is discharged to the upper discharge plane 26 as shown in FIG. 7. At this time, a leading end (an end on the downstream side in the discharge direction) of the sheet P1 comes into contact with the contact piece 71, and the contact piece 71 is rotated in the direction of arrow D42 in FIG. 4 or in the direction of arrow D51 in FIG. 5. As a result, the shaft 72 connected to the contact piece 71 is also rotated by a predetermined angle in the direction of arrow D54 in FIG. 5. In association with the rotation of the shaft 72, the projection part 723 (FIG. 5, FIG. 6) projecting from the shaft 72 is also rotated in the direction of arrow D62 in FIG. 6. At this time, the projection part 723 moves so as to enter the opening 73A of the cylindrical part 733. The projection part 723 moves around the shaft 72 so as to be apart from the wall surface 733A of the cylindrical part 733. Then, the first detection piece 73 is rotated by its own weight in the direction of arrow D63 in FIG. 6. As a result, the first detection piece 73 is positioned at a position shown in FIG. 8. That is, the magnet 731A of the first detection piece 73 is positioned close to the reed switch 75. With the approach of the magnet 731A, an induced electromotive force is generated in the reed switch 75, and thereby the reed switch 75 is set in the current conducting state. Accordingly, it is detected that a sheet P1 is placed on the upper discharge plane 26, that is, a sheet P is discharged (second state), by detecting the current output from the reed switch 75 to the control portion (not shown). Then, the control portion instructs the LCD touch panel 222 to display intermittent lighting indicating that one sheet is placed on the upper discharge plane 26.

On the other hand, in association with the rotation of the shaft 72 from the first state to the second state (arrow D54 in FIG. 5), the second detection piece 74 is slightly rotated upward (arrow D53 in FIG. 5). In this stage, however, the light blocking part 741 of the second detection piece 74 is still blocking the detection light between the light-emitting part 761 and the light-receiving part 762 of the photointerrupter 76.

When sheets P are continuously discharged to the upper discharge plane 26 from the second state, the leading edges of the plurality of sheets P at the upstream side in the discharge direction are appropriately aligned by the sloped parts 242A1 of the discharge ribs 242A. In association with the discharge of the plurality of sheets P, the contact piece 71 is pressed by the sheets P and gradually rotated in the direction of arrow D71 in FIG. 7 or in the direction of arrow D81 in FIG. 8. At this time, as shown in FIG. 8, since the end part 731 of the first detection piece 73 is in contact with a bottom 751 of the reed switch 75, the first detection piece 73 is stopped. Accordingly, the reed switch 75 remains in the state of detecting the first detection piece 73. On the other hand, the shaft 72 is rotated in the direction of arrow D82 in FIG. 8 with the projection part 723 thereof entering the opening 73A of the cylindrical part 733. At this time, the shaft 72 can be rotated while the first detection piece 73 is not rotated. Therefore, the shaft 72 can be rotated relative to the first detection piece 73. Thus, the rotation of the shaft 72 from the second state to the third state can be utilized for movement of the second detection piece 74.

Then, as shown in FIG. 9, a bundle of sheets PV corresponding to the sheets P in the full load state is loaded on the upper discharge plane 26. At this time, as shown in FIG. 10, a lower end surface 741A of the light blocking part 741 moves upward and away from the detection light L between the light-emitting part 761 and the light-receiving part 762. As a result, the control portion (not shown) connected to the photointerrupter 76 detects the full load state (third state) of the sheets P. Then, the control portion instructs the LCD touch panel 222 to display intermittent lighting indicating that the upper discharge plane 26 is fully loaded with the sheets P. At this time, the interval of lighting of the LCD touch panel 222 is set longer than that in the above-mentioned second state. Therefore, the user is informed of the second state and the third state that are appropriately identified by the different lighting times of the LCD touch panel 222.

Thereafter, when the sheets P are taken out from the upper discharge plane 26 by the user, the contact piece 71 again moves to the stand-by position shown in FIG. 4 by its own weight. Therefore, it is possible to appropriately detect the first state of a sheet P to be next discharged from the upper discharge roller pair 135. At this time, in association with the movement of the contact piece 71 to the stand-by position, the light blocking part 741 of the second detection piece 74 again enters the space between the light-emitting part 761 and the light-receiving part 762. Further, in association with rotation of the shaft 72, the projection part 723 presses against the wall surface 733A (FIG. 5) of the cylindrical part 733. As a result, the first detection piece 73 is lifted upward to be positioned at a position apart from the reed switch 75.

As described above, in the cross section intersecting the sheet width direction, the contact piece 71 and the discharge rib 242A overlap each other in the vertical direction (FIG. 4). Further, the contact piece 71 is disposed at a predetermined distance in the left-right direction from the rear edge 242A3 of the discharge rib 242A. Therefore, in the transition from the first state to the second state, the leading edge of the sheet P1 presses the contact piece 71 until the contact piece 71 moves leftward beyond the rear edge 242A3 of the discharge rib 242A. In other words, the shaft 72 is rotated until the contact piece 71 moves to the left of the rear edge 242A3 from the stand-by position shown in FIG. 4. Accordingly, it is possible to convert the movement of the contact piece 71 into rotation of the shaft 72 at an angle as large as possible. That is, the amount of movement of the contact piece 71 and the angle of rotation of the shaft 72 are appropriately maintained until the contact piece 71 moves away from the discharge rib 242A. Particularly, in the present embodiment, the reed switch 75 detects the first detection piece 73. The current conducting state of the reed switch 75 is varied by the magnetic field of the magnet 731A. At this time, in order to cut off the current conduction to the reed switch 75, the magnet 731A needs to be apart from the reed switch 75 by a relatively long distance. Accordingly, the rotation of the shaft 72 (first detection piece 73) caused by the movement of the contact piece 71 realizes stable detection of the first detection piece 73 by the reed switch 75.

Figure 11:
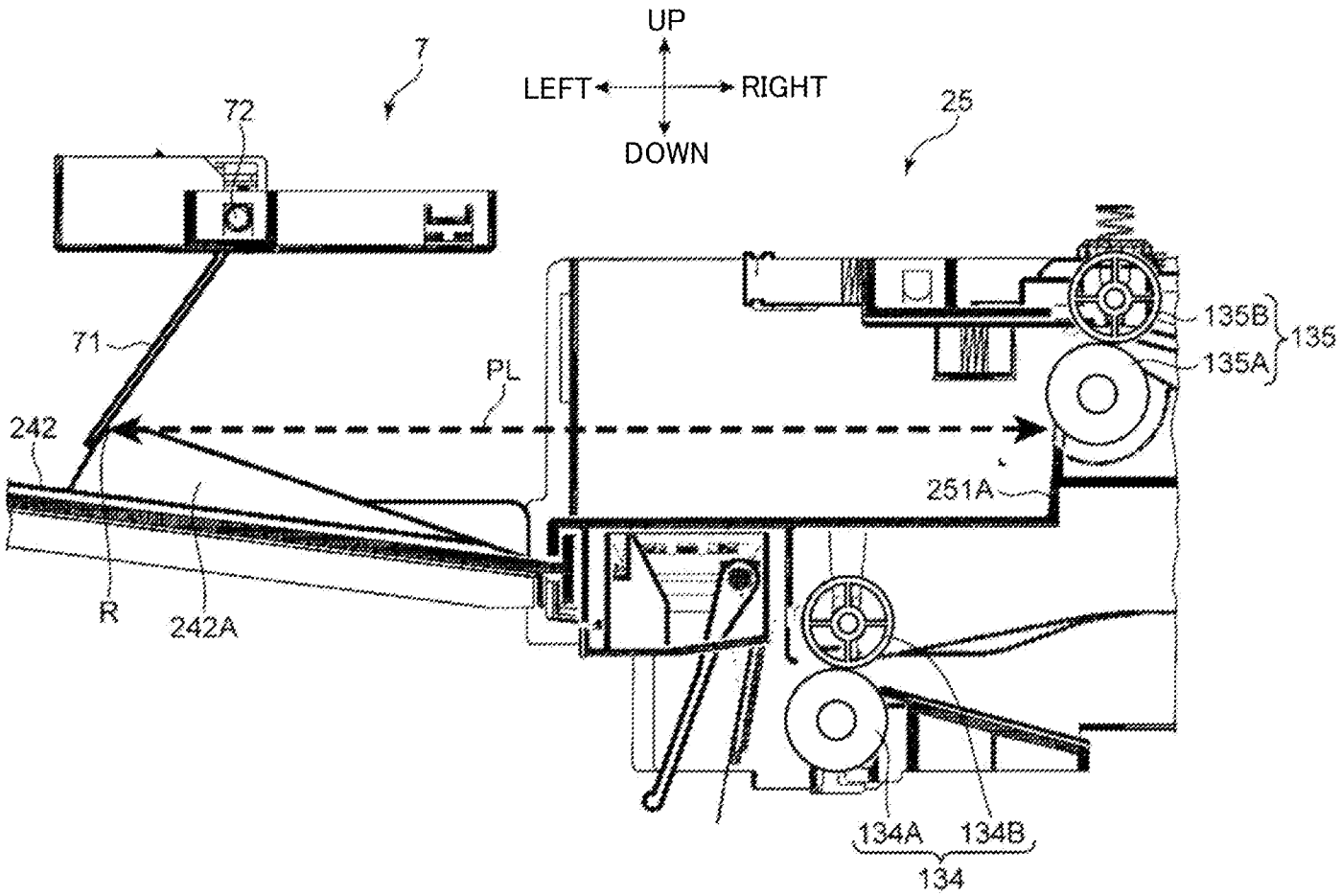
FIG. 11 is a cross-sectional view of the upper discharge portion of the image forming apparatus shown in FIG. 1.

Further, in the present embodiment, as shown in FIG. 11, an upper plate wall part 251A is disposed on the lower side of the upper discharge roller pair 135. The edge, on the upstream side in the discharge direction, of the sheet P placed on the upper discharge plane 26 comes into contact with the upper plate wall part 251A. In a cross section intersecting the sheet width direction, a distance, in the discharge direction, between the upper plate wall part 251A and a point R (separation position) at which the contact piece 71 moves away from the discharge rib 242A is defined as PL. In the present embodiment, the distance PL is set to be shorter than the length, in the discharge direction, of a minimum-size sheet among sheets P to be discharged to the upper discharge plane 26. Since the edge, on the upstream side in the discharge direction, of the minimum-size sheet comes into contact with the upper plate wall part 251A, the leading edges (the edges on the downstream side in the discharge direction) of the sheets P reliably come into contact with the contact piece 71.

According to the above-mentioned embodiment, the single contact piece 71 appropriately detects that one sheet P is placed on the upper discharge plane 26, and that the upper discharge plane 26 is fully loaded with sheets P. Further, the edges, on the upstream side in the discharge direction, of the sheets P discharged to the upper discharge plane 26 are appropriately aligned by the sloped parts 242A1 of the discharge ribs 242A. Further, the lower end 710 of the contact piece 71, in the stand-by position in the first state, is extended downward to a position lower than the upper edge 242A2 of the discharge rib 242A. Therefore, the sheet P placed on the discharge rib 242A reliably comes into contact with the contact piece 71, and thereby the contact piece 71 is rotated about the shaft 72. At this time, in the cross section intersecting the sheet width direction, the discharge rib 242A and the contact piece 71 overlap each other. Therefore, the shaft 72 can be appropriately rotated until the contact piece 71 moves away from the discharge rib 242A. Accordingly, by using the rotation force, the sheet detecting portion 7 can detect the loaded state of the sheets P.

The upper discharge portion 25 (sheet loading device) and the image forming apparatus 1 according to the embodiment of the present disclosure have been described. However, the present disclosure is not limited to them, and can be modified as follows.

In the above-described embodiment, the reed switch 75 is provided as the first sheet detecting portion, and the photointerrupter 76 is provided as the second sheet detecting portion. However, the present disclosure is not limited thereto. Other detection portions may be disposed so as to oppose the first detection piece 73 and the second detection piece 74, respectively. For example, in another embodiment, a pressure sensor composed of a piezoelectric element may be provided.

Further, in the above-described embodiment, the light blocking part 741 of the second detection piece 74 is disposed between the light-emitting part 761 and the light-receiving part 762 in the first and second states, and the light blocking part 741 is moved away from the space between the light-emitting part 761 and the light-receiving part 762 in the third state. However, the present disclosure is not limited thereto. The light blocking part 741 of the second detection piece 74 may be moved away from the space between the light-emitting part 761 and the light-receiving part 762 in the first and second states, and the light blocking part 741 may be inserted between the light-emitting part 761 and the light-receiving part 762 in the third state.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet loading device, comprising:

a housing;

a sheet discharge portion that discharges a sheet in a predetermined discharge direction;

a sheet loading portion disposed in the housing, on which the sheet discharged from the sheet discharge portion is loaded;

a plurality of ribs protruding upward from the sheet loading portion along the discharge direction, each rib having a sloped part that tapers downward to an upstream side in the discharge direction;

an actuator including a shaft disposed above the sheet loading portion, the shaft extending in a sheet width direction intersecting the discharge direction, and a contact piece extending from the shaft toward the sheet loading portion, in a position where the plurality of ribs are not disposed in the sheet width direction, the contact piece rotating integrally with the shaft when the sheet discharged to the sheet loading portion comes into contact with the contact piece; and a sheet detecting portion capable of detecting, in accordance with the rotation of the contact piece about the shaft, a first state where no sheet is loaded on the sheet loading portion, a second state where one sheet discharged from the sheet discharge portion is loaded on the sheet loading portion, and a third state where sheets as many as a predetermined number of sheets regarded as a full load state are loaded on the sheet loading portion, wherein in the first state, the contact piece is positioned at a stand-by position in which a tip of the contact piece is extended so as to be lower than an upper edge of the plurality of ribs.

2. The sheet loading device according to claim 1, wherein the sheet detecting portion includes:

a housing that rotatably supports the shaft;

a first detection piece that is extended from the shaft in a radial direction of the shaft, and is rotatable integrally with the shaft;

a first sheet detecting portion capable of detecting the first state and the second state in accordance with rotation of the first detection piece;

a second detection piece that is extended from the shaft in the radial direction of the shaft, and is rotatable integrally with the shaft; and a second sheet detecting portion capable of detecting the third state in accordance with rotation of the second detection piece.

3. The sheet loading device according to claim 2, wherein the first detection piece includes a magnetic member in a front end part thereof extending from the shaft, and is positioned apart from the first sheet detecting portion in the first state, and gets close to the first sheet detecting portion when being rotated about the shaft in association with a transition from the first state to the second state, and the first sheet detecting portion is a reed switch whose current conducting state is changed while the magnetic member of the first detection piece gets close to the first sheet detecting portion.

4. The sheet loading device according to claim 3, wherein the second sheet detecting portion is a photointerrupter capable of detecting the second detection piece, and the detection state of the second detection piece by the photointerrupter is changed when the second detection piece is rotated about the shaft in association with a transition from the second state to the third state, and closes in to or moves away from the photointerrupter.

5. The sheet loading device according to claim 3, wherein the shaft rotates relative to the first detection piece in a transition from the second state to the third state.

6. The sheet loading device according to claim 5, wherein the first detection piece includes:

a cylindrical part rotatably externally fitted to the shaft;

an opening opened at a circumferential surface of the cylindrical part, and having a predetermined opening length in a circumferential direction of the shaft; and a detection part that extends from the cylindrical part in a radial direction of the shaft, and contains a magnetic member, the shaft includes:

a circumferential surface; and a projection part that projects from the circumferential surface and is inserted through the opening, wherein in the first state, rotation of the first detection piece about the shaft is prevented when the projection part comes into contact with an edge part of the opening, on one end side in the circumferential direction, among edge parts of the opening, and in the transition from the first state to the second state, the shaft is rotated while the sheet comes into contact with the contact piece, and the first detection piece is rotated about the shaft by its own weight when the projection part moves away from the edge part on the one end side, and gets close to the first sheet detecting portion.

7. The sheet loading device according to claim 6, wherein the first detection piece is in contact with the housing of the sheet detecting portion in the second state and the third state, and in a transition from the second state to the third state, the projection part moves in the opening of the first detection piece that is in contact with the housing of the sheet detecting portion, and thereby the shaft rotates relative to the first detection piece.

8. The sheet loading device according to claim 7, wherein when the sheet is taken out from the sheet loading portion in the second state or the third state, the contact piece moves to the stand-by position by its own weight.

9. The sheet loading device according to claim 8, wherein when the projection part of the shaft presses the edge of the opening on the one end side in association with the movement of the contact piece to the stand-by position, the first detection piece moves away from the first sheet detecting portion.

10. The sheet loading device according to claim 2, wherein the second sheet detecting portion is a photointerrupter capable of detecting the second detection piece, and the detection state of the second detection piece by the photointerrupter is changed when the second detection piece is rotated about the shaft in association with a transition from the second state to the third state, and closes in to or moves away from the photointerrupter.

11. The sheet loading device according to claim 1, including:

a wall part disposed on the lower side of the sheet discharge portion, with which an edge, on the upstream side in the discharge direction, of the sheet loaded on the sheet loading portion comes into contact, wherein in a cross section intersecting an axial direction of the shaft, the contact piece moves away from the plurality of ribs when the sheet discharged from the sheet discharge portion comes into contact with the contact piece in association with a transition from the first state to the second state, and in the discharge direction, a distance between the wall part and a position in which the contact piece moves away from the plurality of ribs is shorter than a length, in the discharge direction, of a minimum-size sheet to be discharged to the sheet loading portion.

12. An image forming apparatus including an image forming portion that forms an image on a sheet, and a sheet loading device to which the sheet on which the image is formed is discharged, the sheet loading device comprising:

a housing;

a sheet discharge portion that discharges a sheet in a predetermined discharge direction;

a sheet loading portion disposed in the housing, on which the sheet discharged from the sheet discharge portion is loaded;

a plurality of ribs protruding upward from the sheet loading portion along the discharge direction, each rib having a sloped part that tapers downward to an upstream side in the discharge direction;

an actuator including a shaft disposed above the sheet loading portion, the shaft extending in a sheet width direction intersecting the discharge direction, and a contact piece extending from the shaft to the sheet loading portion, in a position where the plurality of ribs are not disposed in the sheet width direction, the contact piece rotating integrally with the shaft when the sheet discharged to the sheet loading portion comes into contact with the contact piece; and a sheet detecting portion capable of detecting, in accordance with the rotation of the contact piece about the shaft, a first state where no sheet is loaded on the sheet loading portion, a second state where one sheet discharged from the sheet discharge portion is loaded on the sheet loading portion, and a third state where sheets as many as a predetermined number of sheets regarded as a full load state are loaded on the sheet loading portion, wherein in the first state, the contact piece is positioned at a stand-by position in which a tip of the contact piece is extended so as to be lower than an upper edge of the plurality of ribs.

13. The image forming apparatus according to claim 12, including:

a lighting portion that informs the second state and the third state, wherein a lighting time of the lighting portion is changed so as to distinguish between the second state and the third state.

* * * * *